United States Patent [19]

Junghans et al.

[11] Patent Number: 4,898,129

[45] Date of Patent: Feb. 6, 1990

[54] VALVE CONTROL OF INTERNAL COMBUSTION ENGINES BY MEANS OF A CAM-DRIVEN ROTARY PISTON PUMP

[75] Inventors: Ewald Junghans, Bergisch Gladbach; Gabriel Tittizer, Roesrath, both of Fed. Rep. of Germany

[73] Assignee: Interatom GmbH, Bergisch Gladbach, Fed. Rep. of Germany

[21] Appl. No.: 237,227

[22] Filed: Aug. 26, 1988

[30] Foreign Application Priority Data

Aug. 26, 1987 [DE] Fed. Rep. of Germany ..... 3728511

[51] Int. Cl.[4] ..... F01L 9/02; F04B 1/06

[52] U.S. Cl. ..... 123/90.13; 60/584; 417/383; 123/90.24

[58] Field of Search ..... 123/90.12, 90.13, 90.31, 123/90.24; 417/383, 385, 388, 288; 60/584

[56] References Cited

U.S. PATENT DOCUMENTS

| | | | |
|---|---|---|---|
| 2,306,131 | 12/1942 | Lossau . | |
| 3,682,565 | 8/1972 | Yarger . | |
| 4,258,672 | 3/1981 | Hietikko | 123/90.12 |
| 4,473,048 | 9/1984 | LeBlanc et al. | 123/357 |
| 4,531,491 | 7/1985 | Iiyama et al. | 123/357 |
| 4,538,580 | 9/1985 | Straubel et al. | 123/357 |
| 4,644,924 | 2/1987 | Djordjevic | 123/506 |

FOREIGN PATENT DOCUMENTS

| | | | |
|---|---|---|---|
| 1506443 | 11/1967 | France . | |
| 2480853 | 10/1981 | France . | |
| 2076075 | 11/1981 | United Kingdom | 123/450 |

OTHER PUBLICATIONS

Patent Abstracts of Japan, vol. 10, No. 163, (M-487) [2219], Jun. 11, 1986; and Japan 61 16 215 (Fujio Inoue) Jan. 24, 1986.

*Primary Examiner*—Charles J. Myhre
*Assistant Examiner*—Weilun Lo
*Attorney, Agent, or Firm*—Herbert Lerner; Laurence A. Greenberg

[57] ABSTRACT

A rotary piston pump assembly includes a rotary piston pump having a pump housing. First and second outlets lead fluid out of the pump housing. The fluid is returned into the pump housing through the first outlets and the first outlets are closed during a portion of the rotation of the pump.

8 Claims, 1 Drawing Sheet

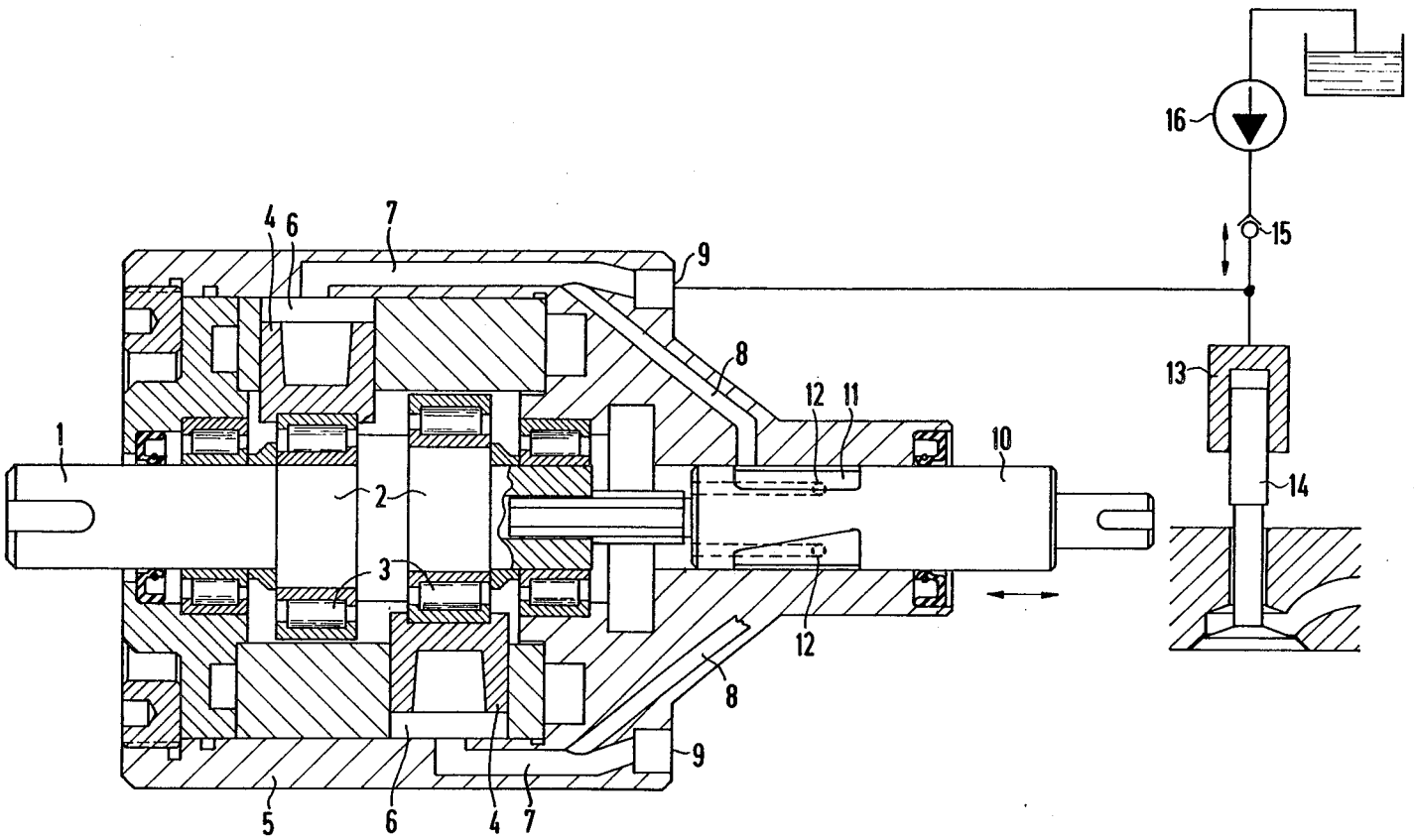
1
2
3
4
5
6
7
8
9
10
11
12
13
14
15
16

VALVE CONTROL OF INTERNAL COMBUSTION ENGINES BY MEANS OF A CAM-DRIVEN ROTARY PISTON PUMP

The invention relates to a rotary piston pump having first and second outlets, and to a connection thereof for controlling the valves of an internal combustion engine.

Published French Patent Application No. 2,480,853 discloses an apparatus for valve control, in which hydraulically actuated valves that are acted upon from a central pressure source have characteristics which are varied by creating a passageway for hydraulic fluid that is variable in accordance with various engine operating parameters by means of two mutually rotatable links. However, an exact valve control cannot be attained with an apparatus of this kind because of the variable viscosity of the hydraulic fluid at the various operating temperatures of the engine. Accordingly, in co-pending U.S. Application Ser. No. 154,794, filed Feb. 10, 1988, now U.S. Pat. No. 4,821,689 the inventors of the instant application have proposed an improved rotary vane by means of which extensive variability of the valve characteristic can be attained. Both prior art apparatus mentioned above draw the hydraulic fluid which is under pressure from a source which is not described in detail, but which would be preferably selected by one of ordinary skill in the art as the lubricant oil pump of the engine which is present in any case. This pump has as constant a pumping characteristic as possible, in order to maintain a constant pressure of the oil being pumped. In other words, it operates only as a pressure pump and is not adapted to the needs of the valve control, which opens the valve during a first period of time, closes it again during a second period of time, and finally keeps its closed during a third period of time, during one rotation of the crankshaft.

It is accordingly an object of the invention to provide a valve control of internal combustion engines by means of a cam-driven rotary piston pump, which overcomes the hereinafore-mentioned disadvantages of the heretofore-known devices of this general type, which has a characteristic adapted to the needs described above, which only acts upon the valves intermittently and which functions as both a pressure pump and a suction pump, with the cycles each being associated with one of the valve movements, that is opening or closing. The valve control should take place within a closed loop independent of the lubricant loop of the engine, so that for both applications, the most suitable fluid can be used in each case.

With the foregoing and other objects in view there is provided, in accordance with the invention, a rotary piston pump assembly, comprising a rotary piston pump having a pump housing, first and second outlets for leading fluid out of the pump housing, and means for returning fluid into the pump housing through the first outlets and for closing the first outlets during a portion of the rotation of the pump. During a portion of the rotation of the pump, during which the first outlets are opened, the pump pumps back into the pump housing, so that there is no external pumping action and the controlled valve remains in its position. Once the first outlets are closed, the pump pumps exclusively into the second outlets, and a force is exerted upon the valve that causes its opening. Subsequently, the pump functions as a suction pump and pulls the valve back into the closed position thereof.

In accordance with another feature of the invention, there are provided means for controlling valves of an internal combustion engine with the pump. Control of a valve is the preferred application of the pump according to the invention, which is made possible by the intermittent action thereof that takes place in one or the other direction in alternation.

In accordance with a further feature of the invention, the returning and closing means open the first outlets during a portion of the rotation of the pump corresponding to a portion of the rotation of a crankshaft of the internal combustion engine during which the controlled valves are closed. In this way, the period of time during which the pump does not pump externally corresponds to the period of time during which the controlled valve remains closed in the intended application.

In accordance with an added feature of the invention, the second outlets are each connected to a respective adjusting cylinder for a respective one of the valves. This makes it possible to accomplish the closing movement of the valve without having to use springs, due to the suction action of the pump. This means that the force of such springs need not first be overcome before the valve can open.

In accordance with an additional feature of the invention, the pump housing has a conduit disposed therein leading into the first and second outlets, a cam, and at least one piston movable in radial direction by rotational motion of the cam for pumping into the conduit. The pump functions as a pressure pump, as long as the piston is moved radially outward by the action of the cam, and it functions as a suction pump, as soon as this motion reverses.

In accordance with yet another feature of the invention, the returning and closing means include a rotary vane closing the first outlets. Therefore, the opening and closing of the first outlets takes place by means of a rotary vane.

In accordance with yet a further feature of the invention, there is provided a pump shaft on which the rotary vane is secured.

In accordance with a concomitant feature of the invention, the rotary vane has a variable characteristic. This is done in order to adapt the valve control to the most varied operating states of the engine, so that the duration of the periods of time during which the first outlets are closed or open can also be varied, and so that the period of time during which the valves are opened or closed also correspondingly varies.

Other features which are considered as characteristic for the invention are set forth in the appended claims.

Although the invention is illustrated and described herein as embodied in a valve control of internal combustion engines by means of a cam-driven rotary piston pump, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawing.

The drawing is a fragmentary, diagrammatic, longitudinal axial-sectional view of an embodiment of the invention.

Referring now in detail to the single FIG. of the drawing, there are seen cams or eccentrics 2 which are formed onto or integral with a driven shaft 1, and execute a reciprocating tumbling movement during a rotation of the shaft 1. Through the intermediary of roller bearings 3, this motion is imparted to pistons 4, which are displaceable in cylinder chambers 6 that are suitably radially disposed in a pump housing 5. The empty spaces in the housing 5 are filled with a hydraulic fluid, so that upon a radially outwardly oriented motion of the pistons 4 this fluid is positively displaced into respective conduits 7, which diverge to form first outlets 8 and second outlets 9. The first outlets 8 discharge at the periphery of a rotary vane 10. A portion of this periphery is provided with recesses 11, from which further conduits 12 extend back into the interior of the housing 5 in a closed loop of passageways. If the first outlets 8 are disposed in a position wherein they face one of the recesses 11 on the periphery of the rotary vane, then the hydraulic fluid pumped by the piston 4 is pumped through the further conduits 12 back into the housing 5, where it fills precisely the space that was vacated by the outward motion of the piston 4. Thus no external pumping action occurs. However, if the first outlets 8 are disposed in a position wherein they face parts of the periphery of the rotary vane 10 that are not occupied by the recesses 11, then these recesses are blocked, and the fluid being pumped is pumped through the second outlets 9 into the interior of an adjusting cylinder 13, in which a shaft of a valve 14 which is in the form of a piston is moved, so that the valve 14 opens. Once the piston 4 has attained its radially outermost position, its motion changes to a radially inwardly directed motion as a result of the action of the cams 2, causing a negative pressure to be generated in the applicable cylinder 6. The pressure in the cylinder 6 causes the hydraulic fluid to be aspirated or drawn out of the adjusting cylinder 13, and the valve 14 closes again, since the piston thereof is forced back into the adjusting cylinder 13 as a result of the ambient atmospheric pressure. The closing of the valve 14 coincides with the renewed opening of the first outlets 8, since one of the recesses 11 is again located before the outlets 8 as a result of the rotation of the rotary vane 10. The valve 14 then remains closed independently of the continuous motion of the pistons 14, because then the pump can aspirate or draw from the interior of the housing 5 through the further conduits 12. As indicated by arrows, the rotary vane is longitudinally displaceable, and has extensions with axially dissimilar profiles, so that different portions of the periphery can be occupied by them. As a result, the period of time during which the first outlets 8 remain opened and no pumping action is exerted upon the adjusting cylinder 13 can be varied. Correspondingly, the duration of time during which the valve 14 remains closed can be varied. In order to compensate for the small leakages occurring at the seals of the shaft 1, the rotary vane 10 and the valves 14, the respective loop communicates through a check valve 15 with a source 16 of additional hydraulic fluid, which is under pressure. If the pump is used for controlling valves 14 of an internal combustion engine as described herein, then the shaft 1 is suitably driven from the crankshaft of this engine in any conventional manner known to one skilled in the art, for instance as developed for the drive of camshafts. In the illustrated embodiment, one of the two cams 2 will control an inlet valve and the other will control an outlet valve. In multi-cylinder engines, a corresponding number of pistons 4 distributed over the periphery will be associated with each cam 2, so that the valves of the applicable group are actuated in the desired sequence one after the other.

The foregoing is a description corresponding in substance to German Application P 37 28 511.4, dated Aug. 26, 1987, the International priority of which is being claimed for the instant application, and which is hereby made part of this application. Any material discrepancies between the foregoing specification and the aforementioned corresponding German application are to be resolved in favor of the latter.

We claim:

1. Rotary piston pump assembly, comprising a rotary piston pump having a pump housing and an interior, first outlets for leading fluid out of the interior of said pump, second outlets for leading fluid out of said pump housing, a closed loop of fluid passageways completely disposed within said housing for returning fluid into the interior of said pump through said first outlets, and means for closing said first outlets during a portion of the rotation of said pump.

2. Rotary piston pump assembly according to claim 1, including means for controlling valve of an internal combustion engine with said pump.

3. Rotary piston pump assembly according to claim 2, wherein said closing means open said first outlets during a portion of the rotation of said pump corresponding to a portion of the rotation of a crankshaft of the internal combustion engine during which the controlled valves are closed.

4. Rotary piston pump assembly according to claim 2, wherein said second outlets are each connected to a respective adjusting cylinder for a respective one of the valves.

5. Rotary piston pump assembly according to claim 1, wherein said pump housing has a conduit disposed therein leading into said first and second outlets, a cam, and at least one piston movable in radial direction by rotational motion of said cam for pumping into said conduit.

6. Rotary piston pump assembly according to claim 1, wherein said closing means include a rotary vane closing said first outlets.

7. Rotary piston pump assembly according to claim 6, including a pump shaft on which said rotary vane is secured.

8. Rotary piston pump assembly according to claim 6, wherein said rotary vane has a variable characteristic.

* * * * *